US008216989B2

(12) United States Patent
Silvernail et al.

(10) Patent No.: US 8,216,989 B2
(45) Date of Patent: Jul. 10, 2012

(54) CLEANING COMPOSITION FOR REMOVING/PREVENTING REDEPOSITION OF PROTEIN SOILS

(75) Inventors: Carter Silvernail, Burnsville, MN (US); Erik Olson, Savage, MN (US); Devon Beau Hammel, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/547,698

(22) Filed: Aug. 26, 2009

(65) Prior Publication Data

US 2011/0053821 A1 Mar. 3, 2011

(51) Int. Cl.

| | |
|---|---|
| ***C11D 3/22*** | (2006.01) |
| ***C11D 3/10*** | (2006.01) |
| ***C11D 3/20*** | (2006.01) |
| ***C11D 3/60*** | (2006.01) |

(52) U.S. Cl. ..... 510/220; 510/225; 510/235; 510/276; 510/339; 510/363; 510/435; 510/445; 510/470; 510/474; 510/505; 510/509

(58) Field of Classification Search ..... 510/220, 510/225, 276, 339, 435, 445, 470, 509, 511, 510/235, 363, 474, 505

See application file for complete search history.

(56) References Cited

U.S. PATENT DOCUMENTS

| | | | | | |
|---|---|---|---|---|---|
| 3,852,209 | A | * | 12/1974 | Hofmann | 510/227 |
| 4,102,799 | A | * | 7/1978 | Finck | 510/227 |
| 5,158,778 | A | * | 10/1992 | Donovan et al. | 424/488 |
| 5,252,244 | A | * | 10/1993 | Beaujean et al. | 510/340 |
| 5,415,801 | A | | 5/1995 | Ofosu-Asante | |
| 5,447,648 | A | | 9/1995 | Steindorf | |
| 5,529,724 | A | * | 6/1996 | Falk | 510/417 |
| 5,672,580 | A | * | 9/1997 | Donker et al. | 510/417 |
| 5,786,320 | A | | 7/1998 | Urfer et al. | |
| 6,017,864 | A | | 1/2000 | Brittain et al. | |
| 6,162,778 | A | * | 12/2000 | McKillop et al. | 510/235 |
| 6,358,911 | B1 | * | 3/2002 | Metzger-Groom | 510/446 |
| 6,362,156 | B1 | * | 3/2002 | Hsu et al. | 510/418 |
| 6,369,018 | B1 | * | 4/2002 | Hsu et al. | 510/418 |
| 6,835,703 | B1 | * | 12/2004 | Cho et al. | 510/221 |
| 6,846,796 | B2 | * | 1/2005 | Schmid | 510/446 |
| 2002/0028755 | A1 | * | 3/2002 | Van Dijk et al. | 510/392 |
| 2002/0052302 | A1 | * | 5/2002 | Clark et al. | 510/276 |
| 2003/0111097 | A1 | | 6/2003 | Everson et al. | |
| 2005/0090412 | A1 | * | 4/2005 | Hsu et al. | 510/130 |
| 2005/0176610 | A1 | * | 8/2005 | Hsu et al. | 510/280 |
| 2006/0094633 | A1 | * | 5/2006 | Overwater | 510/446 |
| 2007/0265181 | A1 | * | 11/2007 | Kikuchi et al. | 510/125 |
| 2009/0088362 | A1 | | 4/2009 | Lant et al. | |

FOREIGN PATENT DOCUMENTS

| | | | |
|---|---|---|---|
| DE | 167663 | | 2/1906 |
| EP | 1997874 | A1 | 12/2008 |
| EP | 2014757 | A1 | 1/2009 |
| GB | 1167663 | | 10/1969 |
| WO | WO 2009/006603 | A1 | 1/2009 |
| WO | WO 2009/040731 | A2 | 4/2009 |

* cited by examiner

*Primary Examiner* — Lorna M Douyon

(74) *Attorney, Agent, or Firm* — Andrew D. Sorensen; Shaoni L. Mitchell

(57) ABSTRACT

A composition is provided for removing protein soil and preventing redeposition of soils onto a surface. The composition includes between about 1% and about 90% by weight sugar, between about 1% and about 80% by weight alkalinity source and between about 15 and about 10% by weight surfactant composition. The sugar may be a saccharide or a non-saccharide based sugar. The composition is substantially free of phosphorus-containing compounds and includes less than about 0.05% by weight alkali earth metal.

4 Claims, No Drawings

CLEANING COMPOSITION FOR REMOVING/PREVENTING REDEPOSITION OF PROTEIN SOILS

TECHNICAL FIELD

The present invention relates generally to the field of cleaning compositions. In particular, the present invention is a composition for, and method of, removing/preventing redeposition of protein soils.

BACKGROUND

Conventional detergents used in the warewashing and laundering industries include alkaline detergents. Alkaline detergents, intended for both institutional and consumer use, typically contain phosphates. Phosphates are multifunctional components commonly used in detergents to reduce water hardness as well as increase detergency, anti-redeposition, and crystal modification. Detergency is defined as the ability to wet, emulsify, suspend, penetrate, and dispense soils.

In particular, polyphosphates such as sodium tripolyphosphate and their salts are used in detergents because of their ability to prevent calcium carbonate precipitation and their ability to disperse and suspend soils. If calcium carbonate is allowed to precipitate, the crystals may attach to the surface being cleaned and cause undesirable effects. For example, calcium carbonate precipitation on the surface of ware can negatively impact the aesthetic appearance of the ware and give the ware an unclean look. In the laundering area, if calcium carbonate precipitates and attaches onto the surface of fabric, the crystals may leave the fabric feeling hard and rough to the touch. In addition to preventing the precipitation of calcium carbonate, the ability of sodium tripolyphosphate to disperse and suspend soils facilitates the detergency of the solution by preventing the soils from redepositing into the wash solution or wash water.

Due to ecological concerns, work has recently been directed to replacing phosphorous in detergents. There is therefore a need in the art for an environmentally friendly multifunctional component that can replace the properties of phosphorous-containing compounds such as phosphates, phosphonates, phosphites, and acrylic phosphinate polymers.

SUMMARY

In one embodiment, the present invention is a method of removing protein soils from a surface and preventing the redeposition of protein soils onto the surface. The method includes introducing a protein-removing/anti-redeposition agent during a washing step of a wash cycle, introducing a cleaning composition during the washing step of the wash cycle, and contacting the surface with the protein-removing/anti-redeposition agent and the cleaning composition. The protein-removing/anti-redeposition agent includes a sugar and the cleaning composition includes an alkalinity source and a surfactant component. The surfactant constitutes up to about 15% by weight of the cleaning composition.

In another embodiment, the present invention is a composition for removing protein soils and preventing redeposition of soils onto a surface. The composition includes between about 1% and about 90% by weight sugar, between about 1% and about 80% by weight alkalinity source, between about 1% and about 10% by weight surfactant component and less than about 0.05% alkali earth metals. The sugar may be a saccharide or a non-saccharide based sugar.

In yet another embodiment, the present invention is a cleaning composition including a sugar, an alkalinity source and a surfactant. A 0.5 to 2.5% solution of the cleaning composition has a pH of between about 10 and about 12.5.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The present invention relates to cleaning compositions and methods of using the cleaning compositions to remove protein soils from surfaces and to prevent redeposition of the soils on surfaces. The cleaning compositions include an agent for removing protein soil and preventing redeposition including a saccharide and/or non-saccharide based sugar. In one embodiment, the cleaning compositions are substantially free of phosphates. Unlike most cleaning compositions currently known in the art, the cleaning compositions do not have to include phosphates to be effective. Thus, the cleaning compositions of the present invention provide a green replacement for conventional cleaning compositions. In addition, in one embodiment, the cleaning compositions are substantially free of alkali earth metals. The cleaning compositions can be used in various industries, including, but not limited to: warewash (institutional and consumer), food and beverage, health and textile care. In particular, the cleaning compositions can be safely used on glass, ceramic, plastic and metal surfaces.

The cleaning composition includes a sugar to aid in removing protein soils/preventing redeposition of soils onto the surface being cleaned. Sugars provide an inexpensive alternative to components traditionally employed to remove protein soils and function as an anti-redeposition agent. In addition, sugars such as sucrose and sorbitol are biodegradable and are Generally Recognized As Safe (GRAS). The sugar can be a saccharide or a non-saccharide based sugar. Exemplary suitable saccharide based sugars include, but are not limited to: glucose, fructose, galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose, theose and combinations thereof. Examples of particularly suitable saccharide based sugars include, but are not limited to, glucose and sucrose. Exemplary suitable non-saccharide based sugars include, but are not limited to: arabitol, erythritol, glycerol, isomalt, lactitol, maltitol, mannitol, sorbitol, xylitol, hydrogenated starch hydrosylate, sucralose, glycyrrhizin, monatin, tagatose and combinations thereof. An example of a particularly suitable non-saccharide based sugar includes, but is not limited to, sorbitol. Combinations of saccharide and non-saccharide based sugars may also be used.

The cleaning composition also includes an alkalinity source, such as an alkali metal hydroxide, alkali metal carbonate, or alkali metal silicate. Examples of suitable alkalinity sources include, but are not limited to: sodium hydroxide, potassium hydroxide, sodium carbonate, potassium carbonate or a mixture of alkali metal hydroxide and alkali metal carbonate. Examples of particularly suitable alkalinity sources include, but are not limited to: sodium carbonate, sodium hydroxide, or a mixture of sodium carbonate and sodium hydroxide. The alkalinity source controls the pH of the resulting solution when water is added to the cleaning composition to form a use solution. The pH of the cleaning composition must be maintained in the alkaline range in order to provide sufficient detergency properties. In an exemplary embodiment, at between about a 0.5% and about a 2.5% solution, the pH of the cleaning composition is between approximately 10 and approximately 12.5. If the pH of the cleaning composition is too low, for example, below approximately 10, the cleaning composition may not provide adequate detergency properties. If the pH of the cleaning composition is too high, for example, above approximately 12-12.5, the cleaning composition may become too alkaline and begin to attack the surface to be cleaned.

The cleaning composition also includes a surfactant component that functions primarily as a defoamer and as a wetting agent. A variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference.

Examples of suitable anionic surfactants useful in the cleaning composition include, but are not limited to: carboxylates such as alkylcarboxylates (carboxylic acid salts) and polyalkoxycarboxylates, alcohol ethoxylate carboxylates, nonylphenol ethoxylate carboxylates and the like; sulfonates such as alkylsulfonates, alkylbenzenesulfonates, alkylarylsulfonates, sulfonated fatty acid esters and the like; sulfates such as sulfated alcohols, sulfated alcohol ethoxylates, sulfated alkylphenols, alkylsulfates, sulfosuccinates, alkylether sulfates and the like. Some particularly suitable anionic surfactants include, but are not limited to: sodium alkylarylsulfonate, alpha-olefinsulfonate and fatty alcohol sulfates.

Nonionic surfactants can be used for defoaming and as wetting agents. Exemplary nonionic surfactants useful in the cleaning composition include those having a polyalkylene oxide polymer as a portion of the surfactant molecule. Examples of suitable nonionic surfactants include, but are not limited to: chlorine-, benzyl-, methyl-, ethyl-, propyl, butyl- and alkyl-capped polyethylene glycol ethers of fatty alcohols; polyalkylene oxide free nonionics such as alkyl polyglucosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates and the like; nonylphenol ethoxylate, polyoxyethylene glycol ethers and the like; carboxylic acid esters such as glycerol esters, polyoxyethylene esters, ethoxylated and glycol esters of fatty acids and the like; carboxylic amides such as diethanolamine condensates, monoalkanolamine condensates, polyoxyethylene fatty acid amides and the like; and polyalkylene oxide block copolymers including an ethylene oxide/propylene oxide block copolymer. Examples of particularly suitable nonionic surfactants include, but are not limited to: a $C_{12}$-$C_{14}$ fatty alcohol with 3 moles of ethylene oxide (EO) and 6 moles of propylene oxide (PO) and a PO-EO-PO block copolymer surfactant. Examples of suitable commercially available nonionic surfactants include, but are not limited to: PLURONIC 25R2, available from BASF Corporation, Florham Park, N.J.; ABIL B8852, available from Goldschmidt Chemical Corporation, Hopewell, Va.; and Dehypon LS-36 available from Cognis, headquartered in Monheim, Germany.

Cationic surfactants useful for inclusion in the cleaning composition include, but are not limited to: amines such as primary, secondary and tertiary amines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and naphthalene-substituted quaternary ammonium chlorides such as dimethyl-1-naphthylmethylammonium chloride. For a more extensive list of surfactants, see McCutcheon's Emulsifiers and Detergents, which is incorporated herein by reference.

In concentrate form, the component concentrations of the cleaning compositions will vary depending on whether the cleaning composition is in solid or liquid form. In solid form, the cleaning compositions include between about 1 wt % and about 90 wt % sugar, between about 1 wt % and about 80 wt % alkalinity source and between about 1 wt % and about 15 wt % surfactant component. Particularly, the cleaning compositions include between about 1 wt % and about 60 wt % sugar, between about 1 wt % and about 65 wt % alkalinity source and between about 1 wt % and about 10 wt % surfactant component. More particularly, the cleaning compositions include between about 1 wt % and about 35 wt % sugar, between about 1 wt % and about 55 wt % alkalinity source and between about 1 wt % and about 5 wt % surfactant component. In other embodiments, similar concentrations may also be present in the cleaning compositions of the invention.

In liquid form, the cleaning compositions include between about 1 wt % and about 60 wt % sugar, between about 1 wt % and about 40 wt % alkalinity source and between about 1 wt % and about 10 wt % surfactant component. Particularly, the cleaning compositions include between about 1 wt % and about 40 wt % sugar, between about 1 wt % and about 25 wt % alkalinity source and between about 1 wt % and about 6 wt % surfactant component. More particularly, the cleaning compositions include between about 1 wt % and about 20 wt % sugar, between about 1 wt % and about 15 wt % alkalinity source and between about 1 wt % and about 3 wt % surfactant component. In other embodiments, similar concentrations may also be present in the cleaning compositions of the invention.

In one embodiment, the protein-removing/anti-redeposition agent constitutes between about 0.1 wt % and about 85 wt % of the cleaning composition. Particularly, the protein-removing/anti-redeposition agent constitutes between about 1 wt % and about 60 wt % of the cleaning composition. More particularly, the protein-removing/anti-redeposition agent constitutes between about 2 wt % and about 20 wt % of the cleaning composition.

The cleaning composition is also substantially free of phosphorus-containing compounds. Substantially phosphorus-free refers to a composition to which phosphorus-containing compounds are not added. In an exemplary embodiment, the cleaning composition includes less than approximately 2 wt % phosphates, phosphonates, and phosphites, or mixtures thereof. Particularly, the cleaning composition includes less than approximately 1 wt % phosphates, phosphonates, and phosphites. More particularly, the cleaning composition includes less than approximately 0.5 wt % phosphates, phosphonates, and phosphites. Most particularly, the cleaning composition includes less than approximately 0.1 wt % phosphates, phosphonates, and phosphites.

In one embodiment, the cleaning composition is also substantially free of alkali earth metals. Substantially alkali earth metal-free refers to a composition to which alkali earth metals are not added. In an exemplary embodiment, the cleaning composition includes less than approximately 1 wt % alkali earth metals, or mixtures thereof by weight. Particularly, the cleaning composition includes less than approximately 0.5 wt % alkali earth metals. More particularly, the cleaning composition includes less than approximately 0.1 wt % alkali earth metals. Most particularly, the cleaning composition includes less than approximately 0.05 wt % alkali earth metals.

Additional Functional Materials

The cleaning compositions can include additional components or agents, such as additional functional materials. As such, in some embodiments, the cleaning composition including the protein-removing/anti-redeposition agent, alkalinity source and surfactant component may provide a large amount, or even all of the total weight of the cleaning composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use. The cleaning compositions containing the protein-removing/anti-redeposition agent, alkalinity source and surfactant component may optionally contain other soil-digesting components, surfactants, disinfectants, sanitizers, acidulants, complexing agents, corrosion inhibitors, foam inhibitors, dyes, thickening or gelling agents, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Thickening Agents

Thickeners useful in the present invention include those compatible with acidic systems. The viscosity of the cleaning composition increases with the amount of thickening agent, and viscous compositions are useful for uses where the cleaning composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.1 wt % to about 3 wt %, from about 0.1 wt % to about 2 wt %, or about 0.1 wt % to about 0.5 wt %.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Pylakor Acid Bright Red (Pylam), and the like. Fragrances or perfumes that may be included in the compositions include, for example, terpenoids such as citronellol, aldehydes such as amyl cinnamaldehyde, a jasmine such as C1S-jasmine or jasmal, vanillin, and the like.

Rinse Aids

The cleaning composition can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

Bleaching Agents

The cleaning composition can optionally include a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloroamine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

Sanitizers/Anti-Microbial Agents

The cleaning composition can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the cleaning composition can be enhanced by the addition of a material which, when the cleaning composition is placed in use, reacts with the active oxygen to form an activated component. For example, in some embodiments, a peracid or a peracid salt is formed. For example, in some embodiments, tetraacetylethylene diamine can be included within the detergent composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, the cleaning composition is in the form of a solid block, and an activator material for the active oxygen is coupled to the solid block. The activator can be coupled to the solid block by any of a variety of methods for coupling one solid detergent composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the detergent composition, such as by a plastic or shrink wrap or film.

Builders or Fillers

The cleaning composition can optionally include a minor but effective amount of one or more of a filler which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and C1-C10 alkylene glycols such as propylene glycol.

pH Buffering Agents

Additionally, the cleaning composition can be formulated such that during use in aqueous operations, for example in aqueous cleaning operations, the wash water will have a desired pH. For example, a souring agent may be added to the cleaning composition such that the pH of the textile approximately matches the proper processing pH. The souring agent is a mild acid used to neutralize residual alkalines and reduce the pH of the textile such that when the garments come into contact with human skin, the textile does not irritate the skin. Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid ($C_{20}$). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids. Examples of suitable commercially available souring agents include, but are not limited to: TurboLizer, Injection Sour, TurboPlex, AdvaCare 120 Sour, AdvaCare 120 Sanitizing Sour, CarboBrite, and Econo Sour, all available from Ecolab Inc., St. Paul, Minn.

Defoaming Agents

The cleaning composition can optionally include a minor but effective amount of a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548 to Martin et al., 3,334,147 to Brunelle et al., and 3,442,242 to Rue et al., the disclosures of which are incorporated by reference herein.

Anti-Redeposition Agents

The cleaning composition can optionally include an additional anti-redeposition agent capable of facilitating sustained suspension of soils in a cleaning solution and preventing the removed soils from being redeposited onto the substrate being cleaned. Examples of suitable anti-redeposition agents include, but are not limited to: fatty acid amides, fluorocarbon surfactants, complex phosphate esters, polyacrylates, styrene maleic anhydride copolymers, and cellulosic derivatives such as hydroxyethyl cellulose, hydroxypropyl cellulose.

Stabilizing Agents

The cleaning composition may also include stabilizing agents. Examples of suitable stabilizing agents include, but are not limited to: borate, calcium/magnesium ions, propylene glycol, and mixtures thereof.

Dispersants

The cleaning composition may also include dispersants. Examples of suitable dispersants that can be used in the solid detergent composition include, but are not limited to: maleic acid/olefin copolymers, polyacrylic acid, and mixtures thereof.

Hardening Agents/Solubility Modifiers

The cleaning composition may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time.

Adjuvants

The present composition can also include any number of adjuvants. Specifically, the cleaning composition can include stabilizing agents, wetting agents, foaming agents, corrosion inhibitors, biocides and hydrogen peroxide among any number of other constituents which can be added to the composition. Such adjuvants can be pre-formulated with the present composition or added to the system simultaneously, or even after, the addition of the present composition. The cleaning composition can also contain any number of other constituents as necessitated by the application, which are known and which can facilitate the activity of the present compositions.

Embodiments of the Present Compositions

Exemplary concentrate compositions are provided in the following tables.

TABLE 1

| Exemplary Composition #1 (Liquid) | | | |
|---|---|---|---|
| Component | Range (Wt %) | Range (Wt %) | Range (Wt %) |
| Alkalinity Source | 1-40 | 1-25 | 1-15 |
| Filler | 0-10 | 0-10 | 0-10 |
| Surfactants | 1-10 | 1-6 | 1-3 |
| Builder | 1-20 | 1-15 | 1-10 |
| Water | 0-90 | 0-60 | 0-40 |
| Sugar | 1-60 | 1-40 | 1-20 |

TABLE 2

| Exemplary Composition #2 (Solid) | | | |
|---|---|---|---|
| Component | Range (Wt %) | Range (Wt %) | Range (Wt %) |
| Alkalinity Source | 1-80 | 1-65 | 1-55 |
| Filler | 1-60 | 1-40 | 1-20 |
| Surfactants | 1-15 | 1-10 | 1-5 |

TABLE 2-continued

| Exemplary Composition #2 (Solid) | | | |
|---|---|---|---|
| Component | Range (Wt %) | Range (Wt %) | Range (Wt %) |
| Builder | 1-40 | 1-25 | 1-15 |
| Water | 0-35 | 0-25 | 0-20 |
| Sugar | 1-90 | 1-60 | 1-35 |

The concentrate composition of the present invention can be provided as a solid, liquid, or gel, or a combination thereof. In one embodiment, the cleaning compositions may be provided as a concentrate such that the cleaning composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

When provided as a liquid concentrate composition, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

When the cleaning composition includes water in the concentrate, it should be appreciated that the water may be provided as deionized water or as softened water The water provided as part of the concentrate can be relatively free of hardness. It is expected that the water can be deionized to remove a portion of the dissolved solids. Although deionized water is preferred for formulating the concentrate, the concentrate can be formulated with water that has not been deionized. That is, the concentrate can be formulated with water that includes dissolved solids, and can be formulated with water that can be characterized as hard water.

The water used to dilute the concentrate (water of dilution) can be available at the locale or site of dilution. The water of dilution may contain varying levels of hardness depending upon the locale. Service water available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:8. If a light duty cleaning use solution is desired, it is expected that the concentrate can be diluted at a weight ratio of concentrate to water of dilution of up to about 1:256.

In an alternate embodiment, the cleaning compositions may be provided as a ready-to-use (RTU) composition. If the cleaning composition is provided as a RTU composition, a more significant amount of water is added to the cleaning composition as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little as possible in order to reduce transportation costs, it is also desirable to provide a concentrate that can be dispensed accurately. In the case of a liquid concentrate, it is expected that water will be present in an amount of up to about 90 wt %, particularly between about 20 wt % and about 85 wt %, more particularly between about 30 wt % and about 80 wt. % and most particularly between about 50 wt % and about 80 wt %.

In the case of a RTU composition, it should be noted that the above-disclosed cleaning composition may, if desired, be further diluted with up to about 96 wt % water, based on the weight of the cleaning composition.

In use, a cleaning composition including the protein-removing/anti-redeposition agent is applied to a surface to be washed during a washing step of a wash cycle. A wash cycle may include at least a washing step and a rinsing step and may optionally also include a pre-rinsing step. The wash cycle involves dissolving a cleaning composition, which may include components such as, for example, alkalinity sources, builders, surfactants, corrosion inhibitors and the like. During the rinsing step, generally warm or hot water flows over the surfaces to be washed. The rinse water may include components such as, for example, surfactants or rinse aids. The cleaning composition including the protein-removing/anti-redeposition agent of the present invention is used only during the washing step of the wash cycle and is not used during the rinsing step.

During the washing step, the cleaning composition including the protein-removing/anti-redeposition agent contacts the surface and works to clean protein and other residue from the surface. In addition, the protein-removing/anti-redeposition agent aids in preventing soils from depositing onto the surface. Although the sugar-based protein-removing/anti-redeposition agent is discussed as being a part of the cleaning composition, the sugar can optionally be added to the washing step of the wash cycle as a separate component. Thus, in one embodiment, the sugar is introduced into the washing step of a wash cycle independent of a detergent composition. When provided as a separate component, the sugar may be provided at a relatively high level of sugar, up to about 100%, in liquid or solid form and may be introduced manually or automatically.

Compositions of the invention may be useful to clean a variety of surfaces. Invention compositions may be used to clean soils on hard surfaces including but not limited to: ceramics, ceramic tile, grout, granite, concrete, mirrors, enameled surfaces, metals including aluminum, brass, stainless steel, glass, plastic and the like. Compositions of the invention may also be used to clean soiled linens such as towels, sheets, and nonwoven webs. As such, compositions of the invention are useful to formulate hard surface cleaners, laundry detergents, oven cleaners, hand soaps, automotive detergents, and warewashing detergents whether automatic or manual.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

Dehypon LS-36: a $C_{12}$-$C_{14}$ fatty alcohol with 3 moles of ethylene oxide (EO) and 6 moles of propylene oxide (PO) available from Cognis, headquartered in Monheim, Germany.

Pluronic 25R2: a PO-EO-PO block copolymer surfactant available from BASF Corporation, Florham Park, N.J.

Acusol 445ND: a sodium polyacrylate (molecular weight 4,500 g/mol) polymer available from Rohm & Haas Company, Philadelphia, Pa.

Multi-Cycle Spot, Film and Soil Removal Test

To test the ability of compositions to clean glass and plastic, twelve 10 oz. Libbey heat resistant glass tumblers and four Newport plastic tumblers were used. The glass tumblers were cleaned prior to use.

A food soil solution was prepared using a 50/50 combination of beef stew and hot point soil. The concentration of the solution was about 2000 ppm. The soil included two cans of Dinty Moore Beef Stew (1360 grams), one large can of tomato sauce (822 grams), 15.5 sticks of Blue Bonnet Margarine (1746 grams) and powered milk (436.4 grams).

The dishmachine was then filled with an appropriate amount of water. After filling the dishmachine with the water, the heaters were turned on. The final rinse temperature was adjusted to about 180° F. The glasses and plastic tumblers were soiled by rolling the glasses in a 1:1 (by volume) mixture of Campbell's Cream of Chicken Soup: Kemp's Whole Milk three times. The glasses were then placed in an oven at about 160° F. for about 8 minutes. While the glasses were drying, the dishmachine was primed with about 120 grams of the food soil solution, which corresponds to about 2000 ppm of food soil in the pump.

The soiled glass and plastic tumblers were placed in the Raburn rack (see figure below for arrangement; P=plastic tumbler; G=glass tumbler) and the rack was placed inside the dishmachine. The first two columns with the tumblers were tested for soil removal while the second two columns with the tumblers were tested for redeposition.

| | | | |
|---|---|---|---|
| | G | G | |
| | G | G | |
| P | G | G | P |
| P | G | G | P |
| | G | G | |
| | G | G | |

The dishmachine was then started and run through an automatic cycle. When the cycle ended, the top of the glass and plastic tumblers were mopped with a dry towel. The glass and plastic tumblers being tested for soil removal were removed and the soup/milk soiling procedure was repeated. The redeposition glass and plastic tumblers were not removed.

At the beginning of each cycle, an appropriate amount of detergent and food soil were added to the wash tank to make up for the rinse dilution. The soiling and washing steps were repeated for seven cycles.

The glass and plastic tumblers were then graded for protein accumulation using Coommassie Brilliant Blue R stain followed by destaining with an aqueous acetic acid/methanol solution. The Coommassie Brilliant Blue R stain was prepared by combining about 1.25 g of Coommassie Brilliant Blue R dye with about 45 mL of acetic acid and about 455 mL of 50% methanol in distilled water. The destaining solution consisted of 45% methanol and 10% acetic acid in distilled water. The amount of protein remaining on the glass and plastic tumblers after destaining was rated visually on a scale of 1 to 5. A rating of 1 indicated no protein was present after destaining. A rating of 2 indicated that random areas (barely perceptible) were covered with protein after destaining. A rating of 3 indicated that about a quarter of the surface was covered with protein after destaining. A rating of 4 indicated that about half of the glass/plastic surface was covered with protein after desatining. A rating of 5 indicated that the entire surface was coated with protein after destaining.

The ratings of the glass tumblers tested for protein removal were averaged to determine an average protein removal rating from glass surfaces and the ratings of the plastic tumblers tested for protein removal were averaged to determine an average protein removal rating from plastic surfaces. Similarly, the ratings of the glass tumblers tested for redeposition were averaged to determine an average protein redeposition rating for glass surfaces and the ratings of the plastic tumblers tested for protein redeposition were averaged to determine an average protein redeposition rating for plastic surfaces.

Examples 1, 2 and 3 and Comparative Example A

Examples 1, 2 and 3 are compositions of the present invention with component concentrations (in weight percent) of sodium carbonate (soda ash or dense ash), sodium bicarbonate, mono ash, sodium metasilicate, a surfactant premix, potassium hydroxide (45%), water, sodium citrate dehydrate and various sugars, as provided in Table 3. The surfactant premix including the Dehypon LS-36 and Pluronic 25R2 was first mixed together before combining with the remainder of the components.

The compositions of Examples 1, 2 and 3 included about 15 ppm of a saccharide based sugar. In particular, the composition of Example 1 included glucose, the composition of Example 2 included sucrose and the composition of Example 3 included trehalose dehydrate. Because trehalose dehydrate exists as a dihydrate (two water molecules), a slightly higher weight percent was needed than for the glucose and sucrose, as a portion of the weight is water.

The composition of Comparative Example A was prepared similarly to the compositions of Examples 1, 2 and 3, except that the composition of Comparative Example A did not include a sugar.

Table 3 provides the component concentrations for the compositions of Examples 1, 2 and 3 and Comparative Example A.

TABLE 3

| Component | Example 1 (wt %) | Example 2 (wt %) | Example 3 (wt %) | Comp. Example A (wt %) |
|---|---|---|---|---|
| Dense Ash | 61.19 | 61.19 | 61.19 | 60.66 |
| Sodium bicarbonate | 4.77 | 4.77 | 4.57 | 6.8 |
| Mono Ash | 12.95 | 12.95 | 12.95 | 12.95 |
| Sodium metasilicate | 3.16 | 3.16 | 3.16 | 3.16 |
| Dehypon LS-36 | 3.53 | 3.53 | 3.53 | 3.53 |
| Pluronic 25R2 | 1.06 | 1.06 | 1.06 | 1.06 |
| KOH (45%) | 2.08 | 2.08 | 2.08 | 2.08 |
| Water | 4 | 4 | 4 | 4 |
| Sodium citrate dehydrate | 5.76 | 5.76 | 5.76 | 5.76 |
| Sucrose | 0 | 1.5 | 0 | 0 |
| Glucose | 1.5 | 0 | 0 | 0 |
| Trehalose dihydrate | 0 | 0 | 1.7 | 0 |

The compositions of Examples 1, 2 and 3 and Comparative Example A were tested for soil removal and anti-redeposition properties according to the methods described above. Table 4 provides the average visual ratings for the glass and plastic tumblers treated with the compositions of Examples 1, 2 and 3 and Comparative Example A. Generally, an average rating of 3 or below, and particularly an average rating of 2 or below, is considered acceptable.

TABLE 4

| | Example 1 | Example 2 | Example 3 | Comp. Example A |
|---|---|---|---|---|
| Soil Removal | | | | |
| Average Glass Rating | 3.42 | 3 | 2.75 | 4.92 |
| Average Plastic Rating | 4.25 | 5 | 3 | 5 |
| Redeposition | | | | |
| Average Glass Rating | 1 | 1.54 | 1 | 1.625 |
| Average Plastic Rating | 2.5 | 3.375 | 2 | 2 |

As can be see in Table 4, the composition of Example 1 including about 15 ppm of glucose outperformed the composition of Comparative Example A at removing soil from both glass and plastic. The composition of Example 1 had an acceptable anti-redeposition rating for glass and plastic and outperformed the composition of Comparative Example A at preventing redeposition on glass.

The composition of Example 2, which included about 15 ppm of sucrose, outperformed the composition of Comparative Example A at removing soil from glass and performed similarly to the composition of Comparative Example A at removing soil from plastic. The composition of Example 2 also had an acceptable rating for preventing redeposition of soils onto glass and outperformed the composition of Comparative Example A at preventing redeposition of soils onto glass.

Lastly, the composition of Example 3, which included about 15 ppm of trehalose dehydrate, was effective at both removing soil and preventing redeposition on glass and plastic. The composition of Example 3 also either performed similar to or outperformed the composition of Comparative Example A at all test conditions.

Examples 4, 5 and 6 and Comparative Example A

Examples 4, 5 and 6 are compositions of the present invention with component concentrations (in weight percent) of sodium carbonate (soda ash or dense ash), sodium bicarbonate, mono ash, sodium metasilicate, a surfactant premix, potassium hydroxide (45%), water, sodium citrate dehydrate and various sugars, as provided in Table 5. The surfactant premix including the Dehypon LS-36 and Pluronic 25R2 were first mixed together before combining with the remainder of the components.

The compositions of Examples 4, 5 and 6 included about 30 ppm of a saccharide based sugar. In particular, the composition of Example 4 included glucose, the composition of Example 5 included sucrose and the composition of Example 6 included trehalose dehydrate. Because trehalose dehydrate exists as a dihydrate (two water molecules), a slightly higher weight percent was needed than for the glucose and sucrose, as a portion of the weight is water.

The composition of Comparative Example A was prepared similarly to the compositions of Examples 4, 5 and 6, except that the composition of Comparative Example A did not include a sugar.

Table 5 provides the component concentrations for the compositions of Examples 4, 5 and 6 and Comparative Example A.

TABLE 5

| Component | Example 4 (wt %) | Example 5 (wt %) | Example 6 (wt %) | Comp. Example A (wt %) |
|---|---|---|---|---|
| Dense Ash | 61.19 | 61.19 | 61.19 | 60.66 |
| Sodium bicarbonate | 3.27 | 3.27 | 2.97 | 6.8 |
| Mono Ash | 12.95 | 12.95 | 12.95 | 12.95 |
| Sodium metasilicate | 3.16 | 3.16 | 3.16 | 3.16 |
| Dehypon LS-36 | 3.53 | 3.53 | 3.53 | 3.53 |
| Pluronic 25R2 | 1.06 | 1.06 | 1.06 | 1.06 |
| KOH (45%) | 2.08 | 2.08 | 2.08 | 2.08 |
| Water | 4 | 4 | 4 | 4 |
| Sodium citrate dehydrate | 5.76 | 5.76 | 5.76 | 5.76 |
| Sucrose | 0 | 3 | 0 | 0 |
| Glucose | 3 | 0 | 0 | 0 |
| Trehalose dihydrate | 0 | 0 | 3.3 | 0 |

The compositions of Examples 4, 5 and 6 and Comparative Example A were tested for soil removal and anti-redeposition properties according to the methods described above. Table 6 provides the average visual ratings for the glass and plastic tumblers treated with the compositions of Examples 4, 5 and 6 and Comparative Example A. Generally, an average rating of 3 or below, and particularly an average rating of 2 or below, is considered acceptable.

TABLE 6

| | Example 4 | Example 5 | Example 6 | Comp. Example A |
|---|---|---|---|---|
| Soil Removal | | | | |
| Average Glass Rating | 1.46 | 1.82 | 1.46 | 4.92 |
| Average Plastic Rating | 2 | 3.5 | 4.5 | 5 |

TABLE 6-continued

| | Example 4 | Example 5 | Example 6 | Comp. Example A |
|---|---|---|---|---|
| Redeposition | | | | |
| Average Glass Rating | 1 | 1 | 1 | 1.625 |
| Average Plastic Rating | 2 | 2.75 | 3 | 2 |

As can be see in Table 6, at 30 ppm, the performance of the compositions including the saccharide based sugars at removing protein soils and preventing redeposition improved compared to the compositions of Examples 1, 2 and 3, which included only about 15 ppm of the same saccharide based sugars. At about 30 ppm, the composition including glucose (Example 4) was effective at both removing soil and preventing redeposition onto glass and plastic surfaces. The composition of Example 4 also performed similarly or outperformed the composition of Comparative Example A at all test conditions.

The composition of Example 5, which included sucrose, outperformed the composition of Comparative Example A at removing soil from glass and plastic surfaces. However, the composition of Example 5 only removed an acceptable level of protein soils when the test substrate was glass. At 30 ppm, the sucrose was effective at preventing redeposition onto the surface of both glass and plastic.

The composition of Example 6 including trehalose dehydrate was effective at removing soil from glass and outperformed the composition of Comparative Example A at removing soils from both glass and plastic surfaces. The composition of Example 6 was also effective at preventing redeposition of soils on both glass and plastic.

Examples 7, 8 and 9 and Comparative Example A

Examples 7, 8 and 9 are compositions of the present invention with component concentrations (in weight percent) of sodium carbonate (soda ash or dense ash), sodium bicarbonate, mono ash, sodium metasilicate, a surfactant premix, potassium hydroxide (45%), water, sodium citrate dehydrate and various sugars, as provided in Table 7. The surfactant premix including the Dehypon LS-36 and Pluronic 25R2 were first mixed together before combining with the remainder of the components.

The compositions of Examples 7, 8 and 9 included about 60 ppm of a saccharide based sugar. In particular, the composition of Example 7 included glucose, the composition of Example 8 included sucrose and the composition of Example 9 included trehalose dehydrate. Because trehalose dehydrate exists as a dihydrate (two water molecules), a slightly higher weight percent was needed than for the glucose and sucrose because a portion of the weight is water.

The composition of Comparative Example A was prepared similarly to the compositions of Examples 7, 8 and 9, except that the composition of Comparative Example A did not include a sugar.

Table 7 provides the component concentrations for the compositions of Examples 7, 8 and 9 and Comparative Example A.

TABLE 7

| Component | Example 7 (wt %) | Example 8 (wt %) | Example 9 (wt %) | Comp. Example A (wt %) |
|---|---|---|---|---|
| Dense Ash | 61.19 | 61.19 | 60.86 | 60.66 |
| Sodium bicarbonate | 0.27 | 0.27 | 0 | 6.8 |
| Mono Ash | 12.95 | 12.95 | 12.95 | 12.95 |
| Sodium metasilicate | 3.16 | 3.16 | 3.16 | 3.16 |
| Dehypon LS-36 | 3.53 | 3.53 | 3.53 | 3.53 |
| Pluronic 25R2 | 1.06 | 1.06 | 1.06 | 1.06 |
| KOH (45%) | 2.08 | 2.08 | 2.08 | 2.08 |
| Water | 4 | 4 | 4 | 4 |
| Sodium citrate dehydrate | 5.76 | 5.76 | 5.76 | 5.76 |
| Sucrose | 0 | 6 | 0 | 0 |
| Glucose | 6 | 0 | 0 | 0 |
| Trehalose dihydrate | 0 | 0 | 6.6 | 0 |

The compositions of Examples 7, 8 and 9 and Comparative Example A were tested for soil removal and anti-redeposition properties according to the methods described above. Table 8 provides the average visual ratings for the glass and plastic tumblers treated with the compositions of Examples 7, 8 and 9 and Comparative Example A. Generally, an average rating of 3 or below, and particularly an average rating of 2 or below, is considered acceptable.

TABLE 8

| | Example 7 | Example 8 | Example 9 | Comp. Example A |
|---|---|---|---|---|
| Soil Removal | | | | |
| Average Glass Rating | 1.21 | 1.17 | 2.42 | 4.92 |
| Average Plastic Rating | 1.5 | 2.25 | 3 | 5 |
| Redeposition | | | | |
| Average Glass Rating | 1 | 1 | 1 | 1.625 |
| Average Plastic Rating | 1.75 | 1 | 2 | 2 |

As can be see in Table 8, once the concentration of sugar in the detergents increased to about 60 ppm, the performance of the compositions including the saccharide based sugars all performed at acceptable levels for removing soils and for preventing redeposition on both glass and plastic surfaces. In addition, the compositions of Examples 7, 8 and 9 either performed as well as or outperformed the composition of Comparative Example A in both tests for glass and plastic surfaces.

Examples 10, 11, 12 and 13 and Comparative Example B

Once it was determined that increasing the concentrations of saccharide based sugars increased the ability of a detergent to remove protein soil and prevent redeposition, various compositions were formed including a polymer. Because polymers are commonly used to control water hardness, the tests were designed to determine whether the sugars effected the performance of polymers.

Examples 10, 11, 12 and 13 are compositions of the present invention with component concentrations (in weight percent) of sodium carbonate (soda ash or dense ash), sodium bicarbonate, mono ash, sodium metasilicate, a surfactant premix, potassium hydroxide (45%), water, sodium citrate dehydrate, Acusol 445ND and various sugars, as provided in Table 9. The surfactant premix including the Dehypon LS-36 and Pluronic 25R2 were first mixed together before combining with the remainder of the components.

The compositions of Examples 10, 11, 12 and 13 included a saccharide based sugar. In particular, the compositions of Examples 10 and 11 included glucose and the compositions of Examples 12 and 13 included sucrose. The only difference between the compositions of Examples 10 and 11 was that the composition of Example 10 included about 30 ppm of glucose and the composition of Example 11 included about 60 ppm of glucose. Likewise, the only difference between the compositions of Examples 12 and 13 was that the composition of Example 12 included about 30 ppm of sucrose and the composition of Example 13 included about 60 ppm of sucrose.

The composition of Comparative Example B was prepared similarly to the compositions of Examples 10, 11, 12 and 13, except that the composition of Comparative Example B did not include a sugar.

Table 9 provides the component concentrations for the compositions of Examples 10, 11, 12 and 13 and Comparative Example B.

TABLE 9

| Component | Example 10 (wt %) | Example 11 (wt %) | Example 12 (wt %) | Example 13 (wt %) | Comp. Example B (wt %) |
|---|---|---|---|---|---|
| Dense Ash | 60.66 | 60.66 | 60.66 | 60.66 | 60.66 |
| Sodium bicarbonate | 3.8 | 0.8 | 3.8 | 0.8 | 6.8 |
| Mono Ash | 12.95 | 12.95 | 12.95 | 12.95 | 12.95 |
| Sodium metasilicate | 3.16 | 3.16 | 3.16 | 3.16 | 3.16 |
| Dehypon LS-36 | 3.53 | 3.53 | 3.53 | 3.53 | 3.53 |
| Pluronic 25R2 | 1.06 | 1.06 | 1.06 | 1.06 | 1.06 |
| KOH (45%) | 2.08 | 2.08 | 2.08 | 2.08 | 2.08 |
| Water | 4 | 4 | 4 | 4 | 4 |
| Sodium citrate dehydrate | 3.26 | 3.26 | 3.26 | 3.26 | 3.26 |
| Acusol 445ND | 2.5 | 2.5 | 2.5 | 2.5 | 2.5 |
| Sucrose | 0 | 0 | 3 | 6 | 0 |
| Glucose | 3 | 6 | 0 | 0 | 0 |

The compositions of Examples 10, 11, 12 and 13 and Comparative Example B were tested for soil removal and anti-redeposition properties according to the methods described above. Table 10 provides the average visual ratings for the glass and plastic tumblers treated with the compositions of Examples 10, 11, 12 and 13 and Comparative Example B. Generally, an average rating of 3 or below, and particularly an average rating of 2 or below, is considered acceptable.

TABLE 10

| | Example 10 | Example 11 | Example 12 | Example 13 | Comp. Example B |
|---|---|---|---|---|---|
| Soil Removal | | | | | |
| Average Glass Rating | 1.29 | 1.375 | 1.42 | 1.21 | 3.5 |
| Average Plastic Rating | 2.875 | 2.875 | 2.25 | 2.125 | 4 |
| Redeposition | | | | | |
| Average Glass Rating | 1 | 1.33 | 1.25 | 1.083 | 1.25 |

TABLE 10-continued

| | Example 10 | Example 11 | Example 12 | Example 13 | Comp. Example B |
|---|---|---|---|---|---|
| Average Plastic Rating | 1.25 | 1.25 | 1.25 | 1.125 | 1.5 |

Table 10 illustrates that compositions including about 30 ppm and about 60 ppm of sugar do not affect the ability of the sugar to remove/prevent the redeposition of protein soil. In particular, all of the compositions of Examples 10, 11, 12 and 13 had acceptable visual readings for removing protein soils from both glass and plastic surfaces. In addition, the compositions of Examples 10, 11, 12 and 13 also had acceptable visual readings for preventing redeposition on both glass and plastic surfaces.

Overall, the compositions of Examples 10, 11, 12 and 13 either performed as well as or outperformed the composition of Comparative Example B in both tests.

Examples 14, 15, 16 and 17 and Comparative Example A

After it was determined that various saccharide based sugars were effective in enhancing protein soil removal/anti-redeposition properties of a detergent composition, various compositions were prepared using non-saccharide based sugars to see if non-saccharide based sugars would have a similar effect.

Examples 14, 15, 16 and 17 are compositions of the present invention with component concentrations (in weight percent) of sodium carbonate (soda ash or dense ash), sodium bicarbonate, mono ash, sodium metasilicate, a surfactant premix, potassium hydroxide (45%), water, sodium citrate dehydrate and various sugars, as provided in Table 11. The surfactant premix including the Dehypon LS-36 and Pluronic 25R2 were first mixed together before combining with the remainder of the components.

The compositions of Examples 14, 15, 16 and 17 included a non-saccharide based sugar. In particular, the compositions of Examples 14 and 15 included sorbitol and the compositions of Examples 16 and 17 included glycerine. The only difference between the compositions of Examples 14 and 15 was that the composition of Example 14 included about 30 ppm of sorbitol and the composition of Example 15 included about 60 ppm of sorbitol. Similarly, the only difference between the compositions of Examples 16 and 17 was that the composition of Example 16 included about 30 ppm of glycerine and the composition of Example 17 included about 60 ppm of glycerine.

The composition of Comparative Example A was prepared similarly to the compositions of Example 14, 15, 16 and 17, except that the composition of Comparative Example A did not include a sugar.

Table 11 provides the component concentrations for the compositions of Examples 14, 15, 16 and 17 and Comparative Example A.

TABLE 11

| Component | Example 14 (wt %) | Example 15 (wt %) | Example 16 (wt %) | Example 17 (wt %) | Comp. Example A (wt %) |
|---|---|---|---|---|---|
| Dense Ash | 61.19 | 61.19 | 61.19 | 61.19 | 60.66 |
| Sodium bicarbonate | 3.27 | 0.27 | 3.27 | 0.27 | 6.8 |

TABLE 11-continued

| Component | Example 14 (wt %) | Example 15 (wt %) | Example 16 (wt %) | Example 17 (wt %) | Comp. Example A (wt %) |
|---|---|---|---|---|---|
| Mono Ash | 12.95 | 12.95 | 12.95 | 12.95 | 12.95 |
| Sodium metasilicate | 3.16 | 3.16 | 3.16 | 3.16 | 3.16 |
| Dehypon LS-36 | 3.53 | 3.53 | 3.53 | 3.53 | 3.53 |
| Pluronic 25R2 | 1.06 | 1.06 | 1.06 | 1.06 | 1.06 |
| KOH (45%) | 2.08 | 2.08 | 2.08 | 2.08 | 2.08 |
| Water | 4 | 4 | 4 | 4 | 4 |
| Sodium citrate dehydrate | 5.76 | 5.76 | 5.76 | 5.76 | 5.76 |
| Sorbitol | 3 | 6 | 0 | 0 | 0 |
| Glycerine | 0 | 0 | 3 | 6 | 0 |

The compositions of Examples 14, 15, 16 and 17 and Comparative Example A were tested for soil removal and anti-redeposition properties according to the methods described above. Table 12 provides the average visual ratings for the glass and plastic tumblers treated with the compositions of Examples 14, 15, 16 and 17 and Comparative Example A. Generally, an average rating of 3 or below, and particularly an average rating of 2 or below, is considered acceptable.

TABLE 12

| | Example 14 | Example 15 | Example 16 | Example 17 | Comp. Example A |
|---|---|---|---|---|---|
| Soil Removal | | | | | |
| Average Glass Rating | 4.5 | 2.33 | 2.625 | 2.25 | 4.92 |
| Average Plastic Rating | 3 | 3 | 4 | 3 | 5 |
| Redeposition | | | | | |
| Average Glass Rating | 1 | 1.25 | 1 | 1 | 1.625 |
| Average Plastic Rating | 1 | 1 | 2 | 1.75 | 2 |

Table 12 illustrates that the compositions of Examples 15 and 17, which included about 60 ppm of a non-saccharide based sugar, received acceptable visual ratings for removing protein soil from both glass and plastic surfaces. However, at 30 ppm sugar, the composition of Example 14 only removed acceptable levels of soil from plastic and the composition of Example 16 only removed acceptable levels of soil from glass.

Table 12 also shows that the compositions including both 30 ppm and about 60 ppm of sugar effectively prevented redeposition of soils onto glass and plastic surfaces. The compositions of Examples 14, 15, 16 and 17 also received the same visual rating or outperformed the composition of Comparative Example A for the prevention of soil redeposition.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A cleaning composition for removing protein soil and preventing redeposition of soils, the composition consisting of:

(a) between about 1% and about 90% by weight a saccharide based or non-saccharide based a sugar;

(b) between about 1% and about 80% by weight alkalinity source;

(c) between about 1% and about 15% by weight surfactant component, wherein the surfactant component is at least one of: anionic, nonionic, cationic, and zwitterionic surfactants;

(d) less than about 0.05% by weight alkali earth metals;

(e) between about 1% and about 40% by weight builder selected from the group consisting of sodium sulfate, sodium chloride, starch, and C1-C10 alkylene glycols;

(f) wherein about 0.5% to about 2.5% of the cleaning composition has a pH of between about 10 and about 12.5;

(g) wherein the cleaning composition is diluted to a for use solution with a weight ratio of concentrate to water of dilution of up to about 1:256; and (h) wherein the cleaning composition contacts a surface to be cleaned during a washing step of a wash cycle.

2. The composition of claim 1, wherein the saccharide based sugar is at least one of: glucose, fructose, galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose and theose.

3. The composition of claim 1, wherein the non-saccharide based sugar is at least one of: arabitol, erythritol, glycerol, isomalt, lactitol, maltitol, mannitol, sorbitol, xylitol, hydrogenated starch hydrosylate, sucralose, glycyrrhizin, monatin and tagatose.

4. The composition of claim 1, wherein the composition is free of alkali earth metals and phosphorus-containing compounds.

* * * * *